US011270671B1

(12) United States Patent
Dunn et al.

(10) Patent No.: US 11,270,671 B1
(45) Date of Patent: Mar. 8, 2022

(54) CONFIGURING OBJECTIVE-EFFECTUATORS

(71) Applicant: Apple Inc., Cupertino, CA (US)

(72) Inventors: Cameron J. Dunn, Los Angeles, CA (US); Peter Gregory Zion, Lafayette, CO (US); Stuart Harl Ferguson, Sunnyvale, CA (US); Peter Justin Dollar, Mountain View, CA (US); David Adam Lipton, San Mateo, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 16/863,611

(22) Filed: Apr. 30, 2020

Related U.S. Application Data

(60) Provisional application No. 62/855,150, filed on May 31, 2019.

(51) Int. Cl.
*G09G 5/37* (2006.01)

(52) U.S. Cl.
CPC ..... *G09G 5/37* (2013.01); *G09G 2340/0407* (2013.01); *G09G 2354/00* (2013.01)

(58) Field of Classification Search
None
See application file for complete search history.

(56) References Cited

FOREIGN PATENT DOCUMENTS

WO WO-2020219379 A1 * 10/2020 ..... G06K 9/2063
WO WO-2020223140 A1 * 11/2020 ..... G06K 9/3233

* cited by examiner

*Primary Examiner* — Yi Wang
(74) *Attorney, Agent, or Firm* — Fernando & Partners, LLP

(57) ABSTRACT

Various implementations disclosed herein include devices, systems, and methods for configuring objective-effectuators. A device includes a display, a non-transitory memory and one or more processors coupled with the display and the non-transitory memory. A method includes, while displaying a computer-generated reality (CGR) representation of a first objective-effectuator in a CGR environment, determining to display a CGR representation of a second objective-effectuator in association with the CGR representation of the first objective-effectuator. In some implementations, the second objective-effectuator is associated with a set of configuration parameters. In some implementations, the method includes determining a value for at least a first configuration parameter of the set of configuration parameters based on a type of the first objective-effectuator. In some implementations, the method includes displaying the CGR representation of the second objective-effectuator in the CGR environment in accordance with the value for the first configuration parameter.

19 Claims, 10 Drawing Sheets

CONFIGURING OBJECTIVE-EFFECTUATORS

CROSS-REFERENCE TO RELATED APPLICATION

This application claims the benefit of U.S. Provisional Patent App. No. 62/855,150, filed on May 31, 2019, which is incorporated by reference in its entirety.

TECHNICAL FIELD

The present disclosure generally relates to configuring objective-effectuators.

BACKGROUND

Some devices are capable of generating and presenting computer-generated reality (CGR) environments. Some CGR environments include virtual environments that are simulated replacements of physical environments. Some CGR environments include augmented environments that are modified versions of physical environments. Some devices that present CGR environments include mobile communication devices such as smartphones, head-mountable displays (HMDs), eyeglasses, heads-up displays (HUDs), and optical projection systems. Most previously available devices that present CGR environments are ineffective at presenting representations of certain objects. For example, some previously available devices that present CGR environments are unsuitable for presenting representations of objects that are associated with an action.

BRIEF DESCRIPTION OF THE DRAWINGS

So that the present disclosure can be understood by those of ordinary skill in the art, a more detailed description may be had by reference to aspects of some illustrative implementations, some of which are shown in the accompanying drawings.

Figure 1A:
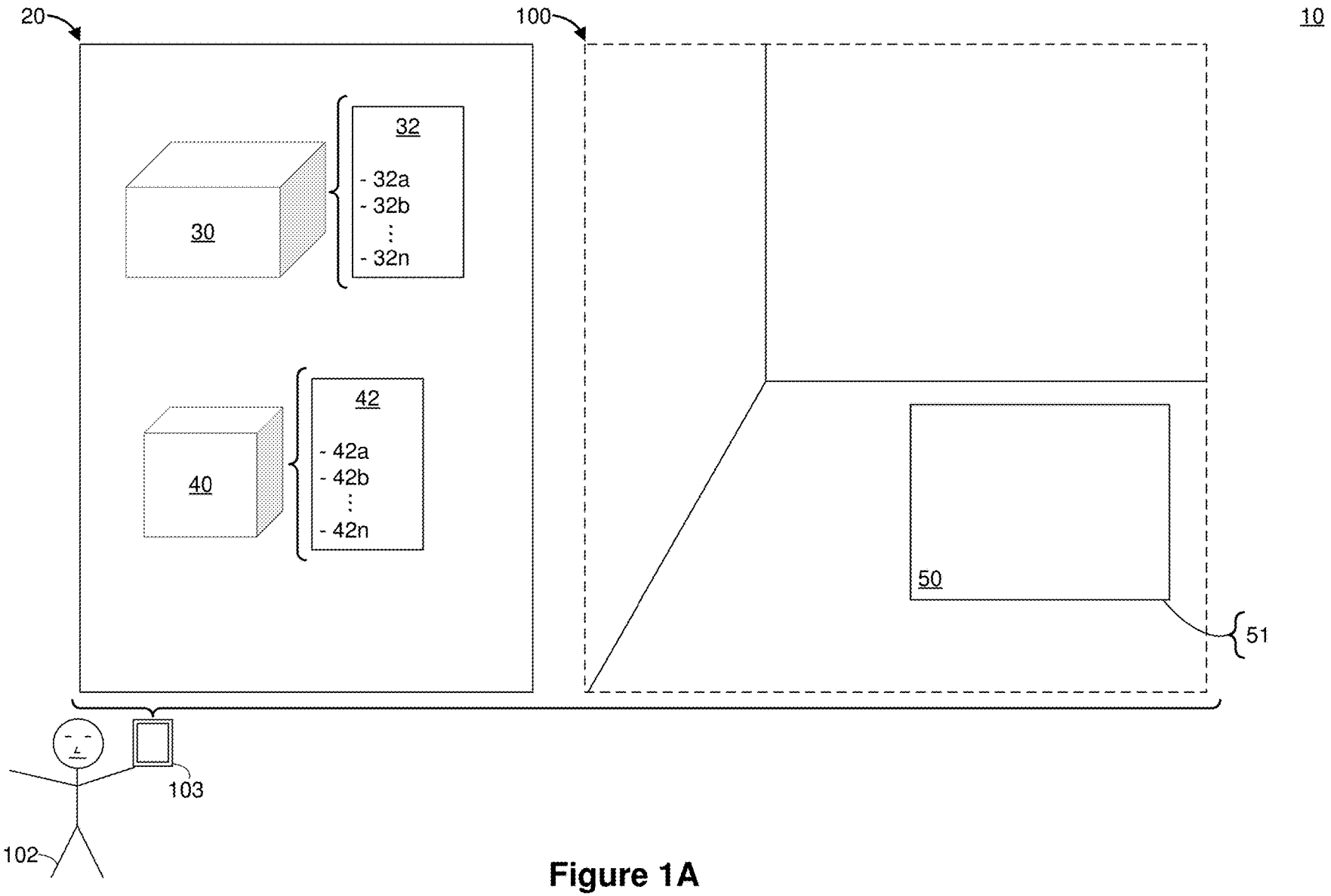
FIGS. 1A-1F are diagrams of an example operating environment in accordance with some implementations.

In accordance with common practice the various features illustrated in the drawings may not be drawn to scale. Accordingly, the dimensions of the various features may be arbitrarily expanded or reduced for clarity. In addition, some of the drawings may not depict all of the components of a given system, method or device. Finally, like reference numerals may be used to denote like features throughout the specification and figures.

SUMMARY

Various implementations disclosed herein include devices, systems, and methods for configuring objective-effectuators. In various implementations, a device includes a display, a non-transitory memory and one or more processors coupled with the display and the non-transitory memory. In some implementations, a method includes, while displaying a computer-generated reality (CGR) representation of a first objective-effectuator in a CGR environment, determining to display a CGR representation of a second objective-effectuator in association with the CGR representation of the first objective-effectuator. In some implementations, the second objective-effectuator is associated with a set of configuration parameters. In some implementations, the method includes determining a value for at least a first configuration parameter of the set of configuration parameters based on a type of the first objective-effectuator. In some implementations, the method includes displaying the CGR representation of the second objective-effectuator in the CGR environment in accordance with the value for the first configuration parameter.

In accordance with some implementations, a device includes one or more processors, a non-transitory memory, and one or more programs. In some implementations, the one or more programs are stored in the non-transitory memory and are executed by the one or more processors. In some implementations, the one or more programs include instructions for performing or causing performance of any of the methods described herein. In accordance with some implementations, a non-transitory computer readable storage medium has stored therein instructions that, when executed by one or more processors of a device, cause the device to perform or cause performance of any of the methods described herein. In accordance with some implementations, a device includes one or more processors, a non-transitory memory, and means for performing or causing performance of any of the methods described herein.

DESCRIPTION

Numerous details are described in order to provide a thorough understanding of the example implementations shown in the drawings. However, the drawings merely show some example aspects of the present disclosure and are therefore not to be considered limiting. Those of ordinary skill in the art will appreciate that other effective aspects and/or variants do not include all of the specific details described herein. Moreover, well-known systems, methods, components, devices and circuits have not been described in exhaustive detail so as not to obscure more pertinent aspects of the example implementations described herein.

A physical environment refers to a physical world that people can sense and/or interact with without aid of electronic systems. Physical environments, such as a physical park, include physical articles, such as physical trees, physical buildings, and physical people. People can directly sense and/or interact with the physical environment, such as through sight, touch, hearing, taste, and smell.

In contrast, a computer-generated reality (CGR) environment refers to a wholly or partially simulated environment that people sense and/or interact with via an electronic system. In CGR, a subset of a person's physical motions, or representations thereof, are tracked, and, in response, one or more characteristics of one or more virtual objects simulated in the CGR environment are adjusted in a manner that comports with at least one law of physics. For example, a CGR system may detect a person's head turning and, in response, adjust graphical content and an acoustic field presented to the person in a manner similar to how such views and sounds would change in a physical environment. In some situations (e.g., for accessibility reasons), adjustments to characteristic(s) of virtual object(s) in a CGR environment may be made in response to representations of physical motions (e.g., vocal commands).

A person may sense and/or interact with a CGR object using any one of their senses, including sight, sound, touch, taste, and smell. For example, a person may sense and/or interact with audio objects that create 3D or spatial audio environment that provides the perception of point audio sources in 3D space. In another example, audio objects may enable audio transparency, which selectively incorporates ambient sounds from the physical environment with or without computer-generated audio. In some CGR environments, a person may sense and/or interact only with audio objects.

Examples of CGR include virtual reality and mixed reality.

A virtual reality (VR) environment refers to a simulated environment that is designed to be based entirely on computer-generated sensory inputs for one or more senses. A VR environment comprises a plurality of virtual objects with which a person may sense and/or interact. For example, computer-generated imagery of trees, buildings, and avatars representing people are examples of virtual objects. A person may sense and/or interact with virtual objects in the VR environment through a simulation of the person's presence within the computer-generated environment, and/or through a simulation of a subset of the person's physical movements within the computer-generated environment.

In contrast to a VR environment, which is designed to be based entirely on computer-generated sensory inputs, a mixed reality (MR) environment refers to a simulated environment that is designed to incorporate sensory inputs from the physical environment, or a representation thereof, in addition to including computer-generated sensory inputs (e.g., virtual objects). On a virtuality continuum, a mixed reality environment is anywhere between, but not including, a wholly physical environment at one end and virtual reality environment at the other end.

In some MR environments, computer-generated sensory inputs may respond to changes in sensory inputs from the physical environment. Also, some electronic systems for presenting an MR environment may track location and/or orientation with respect to the physical environment to enable virtual objects to interact with real objects (that is, physical articles from the physical environment or representations thereof). For example, a system may account for movements so that a virtual tree appears stationery with respect to the physical ground.

Examples of mixed realities include augmented reality and augmented virtuality.

An augmented reality (AR) environment refers to a simulated environment in which one or more virtual objects are superimposed over a physical environment, or a representation thereof. For example, an electronic system for presenting an AR environment may have a transparent or translucent display through which a person may directly view the physical environment. The system may be configured to present virtual objects on the transparent or translucent display, so that a person, using the system, perceives the virtual objects superimposed over the physical environment. Alternatively, a system may have an opaque display and one or more imaging sensors that capture images or video of the physical environment, which are representations of the physical environment. The system composites the images or video with virtual objects, and presents the composition on the opaque display. A person, using the system, indirectly views the physical environment by way of the images or video of the physical environment, and perceives the virtual objects superimposed over the physical environment. As used herein, a video of the physical environment shown on an opaque display is called "pass-through video," meaning a system uses one or more image sensor(s) to capture images of the physical environment, and uses those images in presenting the AR environment on the opaque display. Further alternatively, a system may have a projection system that projects virtual objects into the physical environment, for example, as a hologram or on a physical surface, so that a person, using the system, perceives the virtual objects superimposed over the physical environment.

An augmented reality environment also refers to a simulated environment in which a representation of a physical environment is transformed by computer-generated sensory information. For example, in providing pass-through video, a system may transform one or more sensor images to impose a select perspective (e.g., viewpoint) different than the perspective captured by the imaging sensors. As another example, a representation of a physical environment may be transformed by graphically modifying (e.g., enlarging) portions thereof, such that the modified portion may be representative but not photorealistic versions of the originally captured images. As a further example, a representation of a physical environment may be transformed by graphically eliminating or obfuscating portions thereof.

An augmented virtuality (AV) environment refers to a simulated environment in which a virtual or computer generated environment incorporates one or more sensory inputs from the physical environment. The sensory inputs may be representations of one or more characteristics of the physical environment. For example, an AV park may have virtual trees and virtual buildings, but people with faces photorealistically reproduced from images taken of physical people. As another example, a virtual object may adopt a shape or color of a physical article imaged by one or more imaging sensors. As a further example, a virtual object may adopt shadows consistent with the position of the sun in the physical environment.

There are many different types of electronic systems that enable a person to sense and/or interact with various CGR environments. Examples include head mounted systems, projection-based systems, heads-up displays (HUDs), vehicle windshields having integrated display capability, windows having integrated display capability, displays formed as lenses designed to be placed on a person's eyes (e.g., similar to contact lenses), headphones/earphones, speaker arrays, input systems (e.g., wearable or handheld controllers with or without haptic feedback), smartphones, tablets, and desktop/laptop computers. A head mounted system may have one or more speaker(s) and an integrated opaque display. Alternatively, a head mounted system may be configured to accept an external opaque display (e.g., a smartphone). The head mounted system may incorporate one or more imaging sensors to capture images or video of the physical environment, and/or one or more microphones to capture audio of the physical environment. Rather than an opaque display, a head mounted system may have a transparent or translucent display. The transparent or translucent display may have a medium through which light representative of images is directed to a person's eyes. The display may utilize digital light projection, OLEDs, LEDs, uLEDs, liquid crystal on silicon, laser scanning light source, or any combination of these technologies. The medium may be an optical waveguide, a hologram medium, an optical combiner, an optical reflector, or any combination thereof. In one implementation, the transparent or translucent display may be configured to become opaque selectively. Projection-based systems may employ retinal projection technology that projects graphical images onto a person's retina. Projection systems also may be configured to project virtual objects into the physical environment, for example, as a hologram or on a physical surface.

In various implementations, a CGR representation of an objective-effectuator performs one or more actions in order to effectuate (e.g., advance/satisfy/complete/achieve) one or more objectives of the objective-effectuator. In some implementations, the CGR representation of the objective-effectuator performs a sequence of actions. In some implementations, a device determines (e.g., generates/synthesizes) the actions for the objective-effectuator. In some implementations, the actions generated for the objective-effectuator are within a degree of similarity to actions that a corresponding entity (e.g., a character, equipment and/or a physical article) performs in fictional material or in a physical environment. For example, in some implementations, a CGR representation of an objective-effectuator that corresponds to a fictional action figure performs the action of flying in a CGR environment because the corresponding fictional action figure flies in the fictional material. Similarly, in some implementations, a CGR representation of an objective-effectuator that corresponds to a physical drone performs the action of hovering in a CGR environment because the corresponding physical drone hovers in a physical environment. In some implementations, the device obtains the actions for the objective-effectuator. For example, in some implementations, the device receives the actions for the objective-effectuator from a remote server that determines the actions.

In various implementations, the CGR representation of the objective-effectuator performs an action in order to effectuate (e.g., advance/satisfy/complete/achieve) an objective. In some implementations, an objective-effectuator is associated with a particular objective, and the CGR representation of the objective-effectuator performs actions that improve the likelihood of effectuating that particular objective. In some implementations, the CGR representation of the objective-effectuator is referred to as a CGR object. In some implementations, the CGR representation of the objective-effectuator is referred to as a virtual object.

In some implementations, an objective-effectuator corresponding to a character is referred to as a character objective-effectuator, an objective of the character objective-effectuator is referred to as a character objective, and a CGR representation of the character objective-effectuator is referred to as a CGR character. In some implementations, the CGR character performs actions in order to effectuate the character objective.

In some implementations, an objective-effectuator corresponding to an equipment is referred to as an equipment objective-effectuator, an objective of the equipment objective-effectuator is referred to as an equipment objective, and a CGR representation of the equipment objective-effectuator is referred to as a CGR equipment. In some implementations, the CGR equipment performs actions in order to effectuate the equipment objective.

In some implementations, an objective-effectuator corresponding to an environment is referred to as an environmental objective-effectuator, and an objective of the environmental objective-effectuator is referred to as an environmental objective. In some implementations, the environmental objective-effectuator configures an environment of the CGR environment in order to effectuate the environmental objective.

When an objective-effectuator is instantiated in a CGR environment, various configuration parameters of the objective-effectuator may need to be configured. If the objective-effectuator being instantiated in the CGR environment includes a nested objective-effectuator, then configuration parameters of the nested objective-effectuator may also need to be configured. Requesting a user to provide values for the configuration parameters may result in an excessive number of user inputs. Excessive user inputs result in increased power consumption and may cause a battery of a device to drain faster. Having to provide user inputs to set the values for the configuration parameters may also detract from the user experience of instantiating objective-effectuators in the CGR environment. Since CGR representations of objective-effectuators perform actions that collectively form emergent content, having to manually set the configuration parameters for nested objective-effectuators may slowdown content generation.

The present disclosure provides methods, systems, and/or devices for configuring objective-effectuators that are instantiated in a CGR environment in order to accelerate generation of emergent content. When a user instantiates an objective-effectuator in a CGR environment, a CGR representation of the objective-effectuator is placed in the CGR environment based on values for configuration parameters of the objective-effectuator. The values are determined based on a type of another objective-effectuator that was already instantiated in the CGR environment. Determining the values for configuration parameters of subsequent objective-effectuators based on prior objective-effectuators reduces the need for user inputs that correspond to manual entry of the values. Reducing user inputs improves the performance of the device, for example, by reducing an amount of time that a display of the device is kept ON thereby reducing power consumption of the device and slowing the battery drainage of the device. Reducing user inputs also reduces wear and tear on the device. Determining the values for the configuration parameters with a reduced number of user inputs improves the user experience, for example, by accelerating (e.g., speeding up) the setup of the CGR environment and generation of emergent content. For example, the sooner an objective-effectuator is configured, the sooner a CGR representation of the objective-effectuator starts performing actions in the CGR environment.

FIG. 1A is a block diagram of an example operating environment 10 in accordance with some implementations. While pertinent features are shown, those of ordinary skill in the art will appreciate from the present disclosure that various other features have not been illustrated for the sake of brevity and so as not to obscure more pertinent aspects of the example implementations disclosed herein. To that end, as a non-limiting example, the operating environment 10 includes a CGR library 20 with various CGR objects, and a CGR environment 100. In some implementations, the CGR library 20 and the CGR environment 100 are displayed on an electronic device 103 that can be held by a user 102. In some implementations, the electronic device 103 includes a smartphone, a tablet, a laptop, or the like.

The CGR library 20 includes various CGR objects that can be instantiated in the CGR environment 100. In the example of FIG. 1A, the CGR library 20 includes a CGR house 30 and a CGR stable 40. In some implementations, the CGR house 30 is a CGR representation of a physical house (e.g., a real house) in a physical environment, and the CGR stable 40 is a CGR representation of a physical stable (e.g., a real stable) in a physical environment. In some implementations, the CGR house 30 is associated with house configuration parameters 32 (e.g., a first house configuration parameter 32*a*, a second house configuration parameter 32*b*, . . . , an nth house configuration parameters 32*n*).

In various implementations, values of the house configuration parameters 32 characterize a configuration of the CGR house 30 when the CGR house 30 is instantiated (e.g., placed) in the CGR environment 100. In some implementations, one or more of the configuration parameters 32 characterize dimensions of the CGR house. For example, a value for the first house configuration parameter 32*a* characterizes a number of pixels that the CGR house 30 occupies within the CGR environment 100. In some implementations, one or more of the configuration parameters 32 characterize a style of the CGR house 30. For example, a value for the second house configuration parameter 32*b* characterizes whether the CGR house 30 is a ranch, a colonial, or a split-level house.

In various implementations, the CGR house 30 includes other CGR objects, and the values of the house configuration parameters 32 characterize configurations of the other CGR objects that the CGR house 30 includes. In some implementations, the other CGR objects are nested in the CGR house 30, and the values of the house configuration parameters 32 characterize configurations of the CGR objects that are nested within the CGR house 30 (e.g., type/placement of CGR furniture, size/placement of CGR television, type/number of CGR utensils, etc.). In some implementations, one or more of the house configuration parameters 32 characterize types of amenities that are available in the CGR house 30 when the CGR house 30 is placed in the CGR environment 100. For example, a value for the nth house configuration parameter 32*n* characterizes whether the CGR house 30 has access to public utilities such as an electrical grid, a sewage system, and city water.

In various implementations, the CGR stable 40 is associated with stable configuration parameters 42 (e.g., a first stable configuration parameter 42*a*, a second stable configuration parameter 42*b*, . . . , an nth stable configuration parameter 42*n*). In some implementations, values of the stable configuration parameters 42 characterize a configuration of the CGR stable 40 when the CGR stable 40 is instantiated (e.g., placed) in the CGR environment 100. For example, in some implementations, a value of the first stable configuration parameter 42*a* characterizes a placement location of the CGR stable 40 within the CGR environment 100. In some implementations, a value of the second stable configuration parameter 42*b* characterizes a size of the CGR stable 40 within the CGR environment 100 (e.g., a number of pixels that the CGR stable occupies within the CGR environment 100). In some implementations, values of the stable configuration parameters 42 characterize configuration of CGR objects that are nested within the CGR stable 40 (e.g., size/number of CGR haystacks).

In the example of FIG. 1A, the CGR environment 100 includes a CGR plot of land 50 ("CGR land plot 50", hereinafter for the sake of brevity). The CGR land plot 50 is associated with a plot type 51. Example values for the plot type 51 indicate that the CGR land plot 50 corresponds to a 'farm', is in a 'city', is for 'residential use', or is for 'commercial use'. In some implementations, a value of the plot type 51 limits the potential values for configuration parameters of CGR objects in the CGR library 20. For example, if a value of the plot type 51 indicates that the CGR land plot 50 is for 'commercial use', then the CGR house 30 cannot be placed on the CGR land plot 50. Similarly, in some implementations, if a value of the plot type 51 indicates that the CGR land plot 50 is in a 'city', then a size of the CGR house 30 is limited to a city threshold size.

In some implementations, the CGR library 20 includes a first set of executable instructions (e.g., a first code package and/or a first procedural code) that, when executed by the electronic device 103, causes the electronic device 103 to procedurally generate the CGR house 30. In such implementations, values of the house configuration parameters 32 define a configuration of the CGR house 30. In some implementations, the CGR library 20 includes a second set of executable instructions (e.g., a second code package and/or a second procedural code) that, when executed by the electronic device 103, causes the electronic device 103 to procedurally generate the CGR stable 40. In such implementations, values of the stable configuration parameters 42 define a configuration of the CGR stable 40. More generally, in various implementations, the CGR library 20 stores sets of executable instructions (e.g., code packages and/or procedural codes) that, when executed by the electronic device 103, cause the electronic device 103 to procedurally generate corresponding CGR objects that are defined by values of corresponding configuration parameters.

In some implementations, a head-mountable device (HMD) (not shown), being worn by the user 102, presents (e.g., displays) the CGR library 20 and the CGR environment 100 according to various implementations. In some implementations, the HMD includes an integrated display (e.g., a built-in display) that displays the CGR environment 100. In some implementations, the HMD includes a head-mountable enclosure. In various implementations, the head-mountable enclosure includes an attachment region to which another device with a display can be attached. For example, in some implementations, the electronic device 103 can be attached to the head-mountable enclosure. In various implementations, the head-mountable enclosure is shaped to form a receptacle for receiving another device that includes a display (e.g., the electronic device 103). For example, in some implementations, the electronic device 103 slides/snaps into or otherwise attaches to the head-mountable enclosure. In some implementations, the display of the device attached to the head-mountable enclosure presents (e.g., displays) the CGR environment 100. In various implementations, examples of the electronic device 103 include smartphones, tablets, media players, laptops, etc.

Figure 1B:
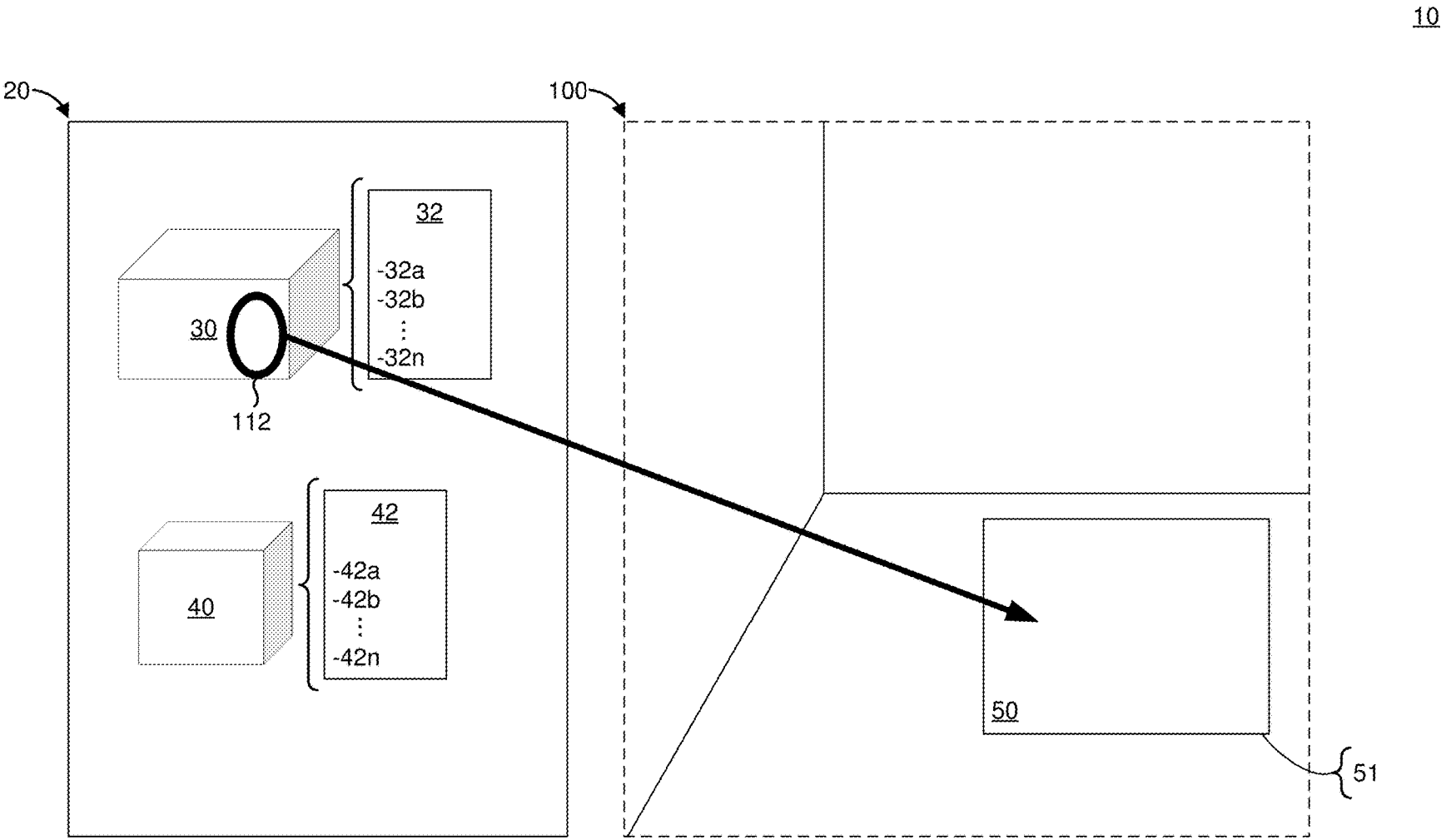

Referring to FIG. 1B, the electronic device 103 detects a user input 112 corresponding to a request to instantiate (e.g., place) the CGR house 30 in the CGR environment 100. In some implementations, the user input 112 corresponds to a request to display the CGR house 30 in association with (e.g., within, adjacent to, abutting from, or proximate to) the CGR land plot 50. In some implementations, the user input 112 includes a tap/press (e.g., a contact) at a location corresponding to the CGR house 30. In some implementations, the user input 112 includes a drag input that starts at the location corresponding to the CGR house 30 and ends at a location within the CGR environment 100 (e.g., at a location corresponding to the CGR land plot 50).

Figure 1C:
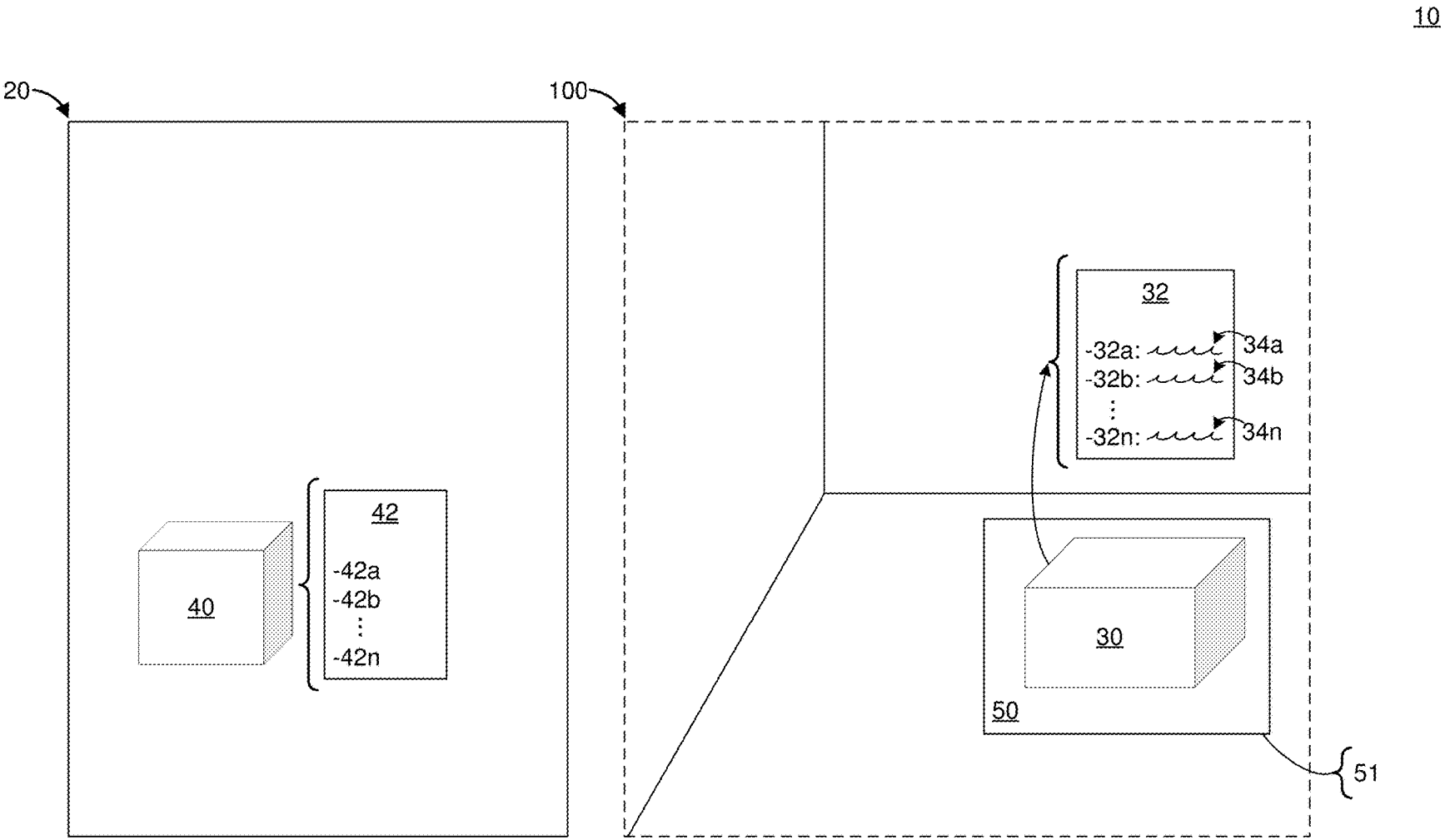

Referring to FIG. 1C, in various implementations, the electronic device 103 determines values for the house configuration parameters 32. For example, the electronic device 103 determines a first value 34*a* for the first house configuration parameter 32*a*, a second value 34*b* for the second house configuration parameter 34*b*, and an nth value 34*n* for the nth house configuration parameter 34*n*.

In some implementations, the electronic device 103 determines the values 34*a*, . . . , 34*n* based on the plot type 51 of the CGR land plot 50. For example, if the plot type 51 indicates that the CGR land plot 50 is in a city and the first house configuration parameter 32*a* characterizes a style of the CGR house 30, then the electronic device 103 selects the first value 34*a* such that the style of the CGR house 30 satisfies a criterion associated with the city (e.g., the first value 34*a* corresponds to a style of the CGR house 30 that has been approved by the city). In some implementations, if the second house configuration parameter 32*b* characterizes CGR furniture in the CGR house 30, then the electronic device 103 selects the second value 34*b* such that the CGR furniture is within a degree of similarity to furniture in city homes (e.g., modern instead of classic). In some implementations, if the nth house configuration parameter 32*n* characterizes CGR utilities in the CGR house 30, then the electronic device 103 selects the nth value 34*n* such that the CGR utilities are within a degree of similarity to utilities in city homes (e.g., a sewage system instead of a septic tank, city water instead of a well, and/or access to an electrical grid instead of a generator or a wind mill).

In some implementations, the plot type 51 indicates that the CGR land plot 50 is a farm. In such implementations, if the first house configuration parameter 32*a* characterizes a style of the CGR house 30, then the electronic device 103 selects the first value 34*a* such that the style of the CGR house 30 is within a degree of similarity to houses on farms. If the second house configuration parameter 32*b* characterizes CGR furniture in the CGR house 30, then the electronic device 103 selects the second value 34*b* such that the CGR furniture is within a degree of similarity to furniture in farmhouses (e.g., classic/antique instead of modern). If the nth configuration parameter 32*n* characterizes CGR utilities in the CGR house 30, then the electronic device 103 selects the nth value 34*n* such that the CGR utilities are within a degree of similarity to utilities in farm houses (e.g., a septic tank instead of a sewage system, a well for water, and/or a gas generator or a wind mill instead of access to an electrical grid).

In the example of FIG. 1C, the electronic device 103 determines the values 34*a*, . . . , 34*n* based on the plot type 51 of the CGR land plot 50. More generally, in various implementations, the electronic device 103 determines the values 34*a*, . . . , 34*n* based on a current state of the CGR environment 100. For example, in some implementations, the electronic device 103 determines the values 34*a*, . . . , 34*n* based on the CGR objects that are already instantiated (e.g., present) in the CGR environment 100. In some implementations, the electronic device 103 determines the values 34*a*, . . . , 34*n* based on a number of the CGR objects that are instantiated in the CGR environment 100. In some implementations, the electronic device 103 determines the values 34*a*, . . . , 34*n* based on one or more characteristics of the CGR objects that are instantiated in the CGR environment 100. Example characteristics include type, dimensions, visual properties (e.g., color), smell properties, aural properties, etc.

In various implementations, the electronic device 103 determines the values 34*a*, . . . , 34*n* for the house configuration parameters 32 based on a limited set of user inputs. In some implementations, the electronic device 103 determines the values 34*a*, . . . , 34*n* for the house configuration parameters 32 without user inputs that correspond to the user 102 manually inputting the values 34*a*, . . . , 34*n* into the electronic device 103 (e.g., in some implementations, the electronic device 103 determines the values 34*a*, . . . , 34*n* automatically).

Figure 1D:
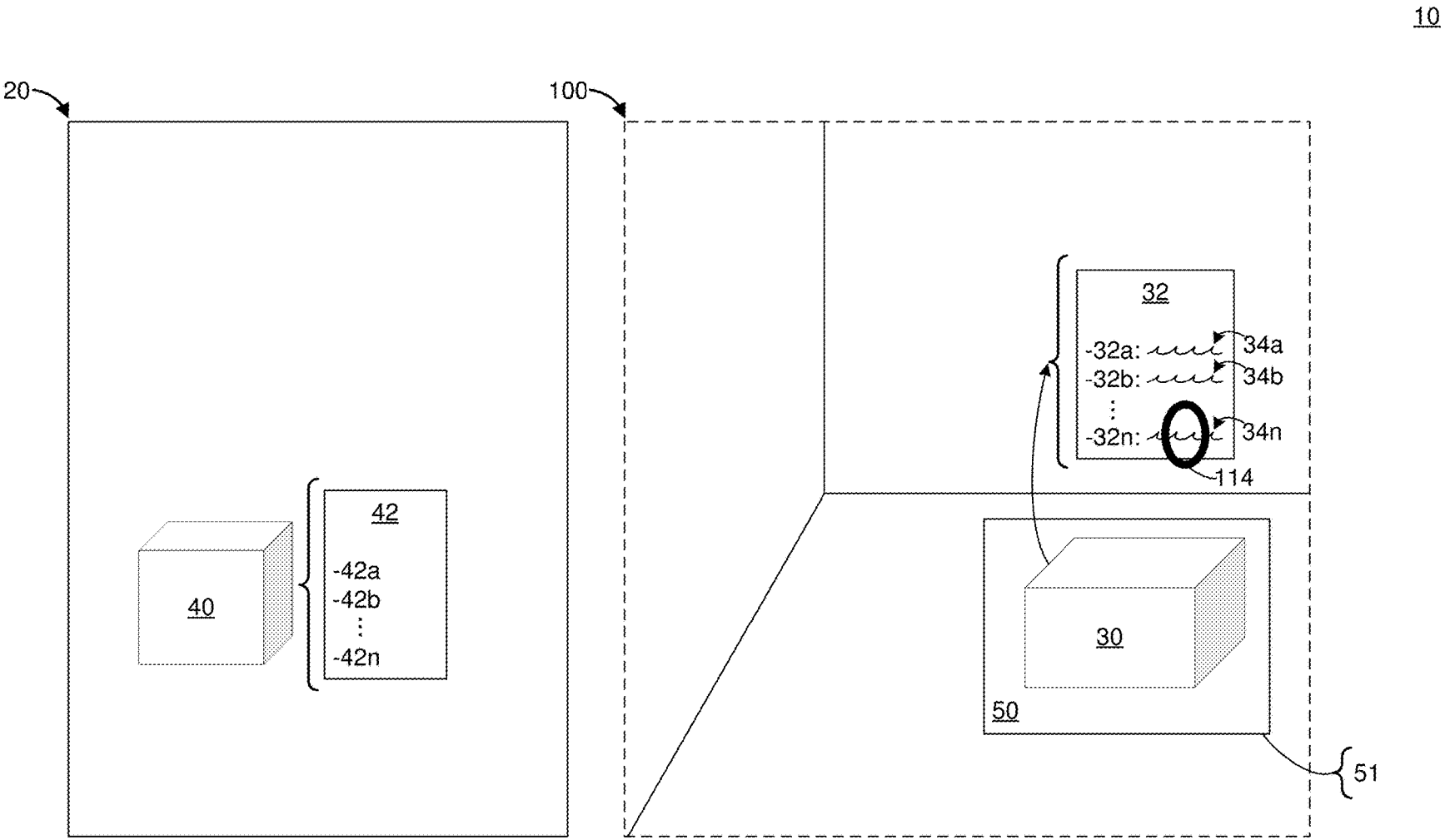
Figure 1E:
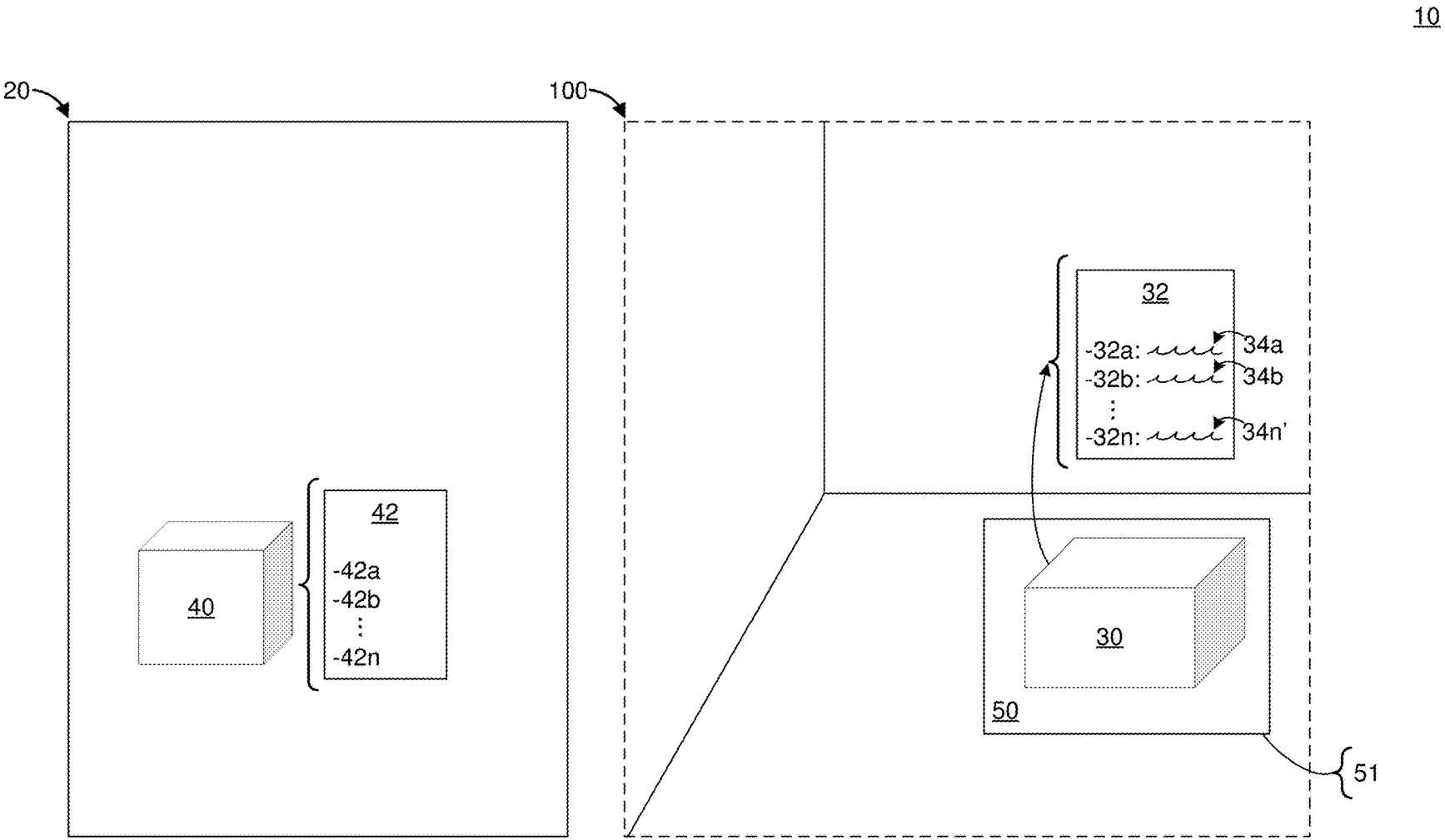

Referring to FIG. 1D, in some implementations, the electronic device 103 provides the user 102 an option to manually change (e.g., override) one of the values 34*a*, . . . , 34*n* that the electronic device 103 determined. In the example of FIG. 1D, the electronic device 103 detects a user input 114 that corresponds to a request to change the nth value 34*n* for the nth house configuration parameter 32*n*. In some implementations, the user input 114 includes a tap/press on the nth value 34*n*. In some implementations, the electronic device 103 displays a graphical user interface (GUI) element (e.g., a text field or a drop-down) that allows the user 102 to modify the nth value 34*n*. As shown in FIG. 1E, the nth house configuration parameter 32*n* has a new value 34*n'*.

Figure 1F:
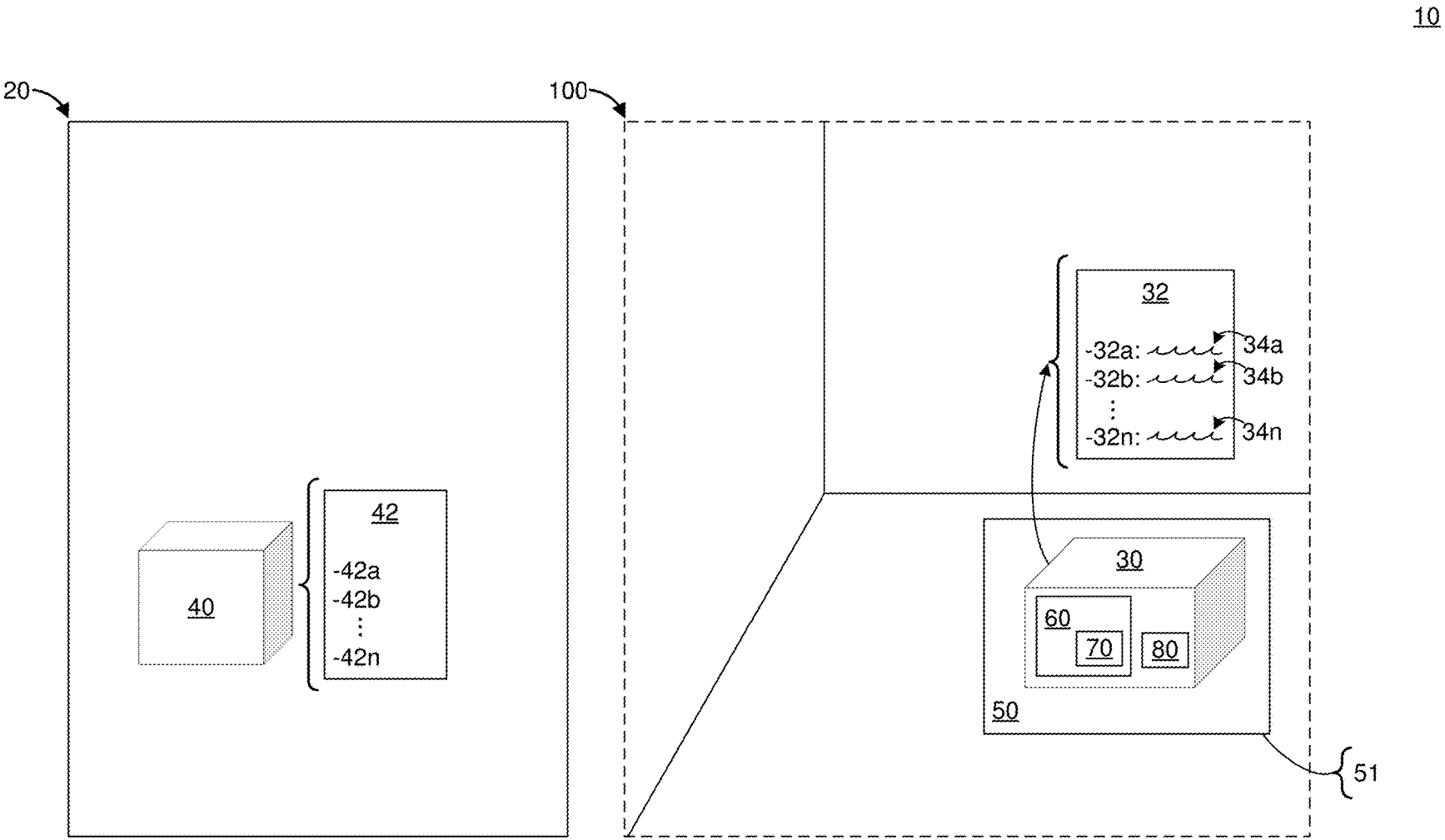

Referring to FIG. 1F, in some implementations, the CGR house 30 includes a set of nested CGR objects. For example, the CGR house 30 includes a CGR kitchen 60 that has CGR appliances 70, and CGR furniture 80. In some implementations, the house configuration parameters 32 correspond to the CGR objects that are nested in the CGR house 30. For example, the first value 34*a* for the first house configuration parameter 32*a* defines a configuration of the CGR kitchen 60, the second value 34*b* for the second house configuration parameter 32*b* defines a configuration of the CGR applications 70, and the nth value for the nth house configuration parameter 80 defines a configuration of the CGR furniture 80. In various implementations, the electronic device 103 determines the values 34*a*, . . . , 34*n* based on the plot type 51 of the CGR land plot 50. For example, if the plot type 51 indicates that the CGR land plot 50 is in a city, then the first value 34*a* indicates that the CGR kitchen 60 is within a degree of similarity to a kitchen in a city home (e.g., instead of a farmhouse kitchen or a restaurant kitchen). Similarly, the second value 34*b* indicates that the CGR appliances 70 are within a degree of similarity to appliances in a city home (e.g., instead of farmhouse appliances or restaurant appliances). The nth value 34*n* indicates that the CGR furniture 80 is within a degree of similarity to furniture in city homes (e.g., instead of furniture that is similar to farmhouse furniture or office furniture).

In the example of FIG. 1F, the electronic device 103 determines (e.g., automatically determines) the values 34*a*, . . . , 34*n* for the house configuration parameters 32 thereby reducing the need for the user 102 to manually input the values 34*a*, . . . , 34*n*. Reducing the need for manual user input enhances the user experience, tends to extend the battery of a battery-operated device, and accelerates emergent content generation because an emergent content engine that generates actions for CGR objects need not wait for the user 102 to manually configure the nested CGR objects before generating actions of the nested CGR objects.

Figure 2:
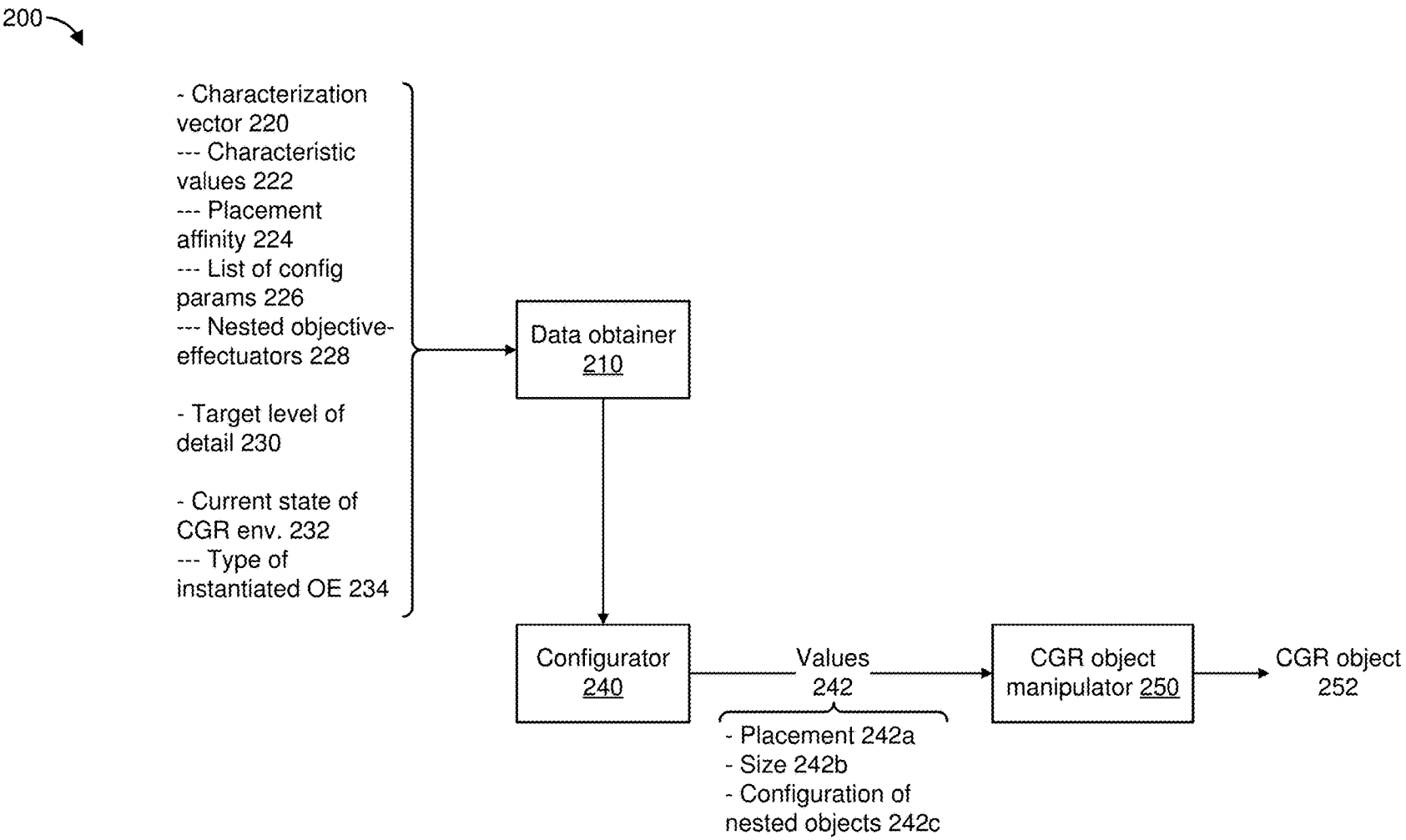
FIG. 2 is a block diagram of an example device in accordance with some implementations.

FIG. 2 is a block diagram of an example device 200 that configures an objective-effectuator. In some implementations, the device 200 implements the electronic device 103 shown in FIG. 1A. In some implementations, the device 200 includes a data obtainer 210, a configurator 240 and a CGR object manipulator 250.

In some implementations, the data obtainer 210 obtains an object characterization vector 220 that characterizes a CGR object 252 representing an objective-effectuator. In some implementations, the data obtainer 210 obtains the object characterization vector 220 after the device 200 receives a request to instantiate the CGR object 252 in a CGR environment. For example, the data obtainer 210 obtains an object characterization vector 220 for the CGR house 30 (shown in FIGS. 1A-1F) after the electronic device 103 detects the user input 112 (shown in FIG. 1B) to instantiate the CGR house 30 in the CGR environment 100.

In some implementations, the object characterization vector 220 includes characteristic values 222 that characterize the CGR object 252. In some implementations, the characteristic values 222 indicate visual properties of the CGR object 252 (e.g., color, texture, material, etc.). In some implementations, the characteristic values 222 indicate dimensions (e.g., a size) of the CGR object 252. In some implementations, the characteristic values 222 indicate aural properties (e.g., audio properties) of the CGR object 252. In some implementations, the characteristic values 222 indicate olfactory properties (e.g., smell properties) of the CGR object 252.

In some implementations, the object characterization vector 220 indicates a placement affinity 224 for the CGR object 252. In some implementations, the placement affinity 224 indicates a placement preference for the CGR object 252. For example, in some implementations, the placement affinity 224 indicates a type of surface on which the CGR object 252 can be placed (e.g., a horizontal surface, a vertical surface, a kitchen countertop, etc.). In some implementations, the placement affinity 224 indicates whether the CGR object 252 can be placed inside another CGR object.

In some implementations, the object characterization vector 220 specifies a set of configuration parameters 226 that are associated with the CGR object 252. For example, the object characterization vector 220 for the CGR house 30 specifies the house configuration parameters 32. In some implementations, the object characterization vector 220 indicates potential values for the configuration parameters 226. For example, the object characterization vector 220 indicates configurable ranges for the configuration parameters 226. For example, the object characterization vector 220 for the CGR house 30 indicates that a style of the CGR house 30 can be set to a ranch-style home, a colonial, a split-level, or a townhome.

In some implementations, the object characterization vector 220 specifies nested objective-effectuators 228 that are associated with the CGR object 252. In some implementations, the nested objective-effectuators 228 refer to other CGR objects that are within the CGR object 252 that is being configured. For example, the object characterization vector 220 for the CGR house 30 indicates that the CGR house 30 includes a CGR kitchen 60, CGR appliances 70 and CGR furniture 80. In some implementations, the object characterization vector 220 indicates that some of the configuration parameters 226 control a configuration of the nested objective-effectuators 228.

In some implementations, the data obtainer 210 obtains a target level of detail 230 for the CGR environment 100. In some implementations, the target level of detail 230 indicates a viewing perspective of the user 102. For example, the target level of detail 230 indicates whether the viewing perspective is inside the CGR object 252 or outside the CGR object 252. In some implementations, the target level of detail 230 indicates a distance from which the CGR object 252 is being viewed or is expected to be viewed.

In some implementations, the data obtainer 210 obtains a current state 232 of the CGR environment 100. In some implementations, the current state 232 indicates CGR objects that are within the CGR environment 100. For example, the current state 232 of the CGR environment 100 indicates that the CGR environment 100 includes the CGR land plot 50. In some implementations, the current state 232 indicates a type 234 of an objective-effectuator that is instantiated in the CGR environment 100. In some implementations, the type 234 indicates a type of the CGR object representing the objective-effectuator that is instantiated in the CGR environment 100. For example, the current state 232 of the CGR environment 100 indicates that the CGR land plot 50 has the plot type 51.

In various implementations, the configurator 240 determines values 242 for the configuration parameters 226 (e.g., the values 34*a*, . . . , 34*n* for the house configuration parameters 32 shown in FIG. 1C) based on data obtained by the data obtainer 210. For example, in some implementations, the configurator 240 determines the values 242 based on the information encoded in the object characterization vector 220. In some implementations, the configurator 240 determines the values 242 based on the target level of detail 230. In some implementations, the configurator 240 determines the values based on the current state 232 of the CGR environment. In some implementations, the configurator 240 determines the values 242 based on the type 234 of the objective-effectuator or the CGR object representing the objective-effectuator.

In some implementations, one or more of the values 242 indicate a placement 242*a* of the CGR object 252. In some implementations, the placement 242*a* indicates whether the CGR object 252 is placed within, adjacent to, abutting from, or proximate to another CGR object that is in the CGR environment. For example, the placement 242*a* indicates whether the CGR house 30 is placed within the CGR land plot 50. In some implementations, the configurator 240 determines the placement 242*a* based on the type 234 of another CGR object that is in the CGR environment. For example, if the plot type 51 indicates that the CGR land plot 50 is for commercial use, then the placement 242*a* indicates that the CGR house 30 is placed outside the CGR land plot 50. However, if the plot type 51 indicates that the CGR land plot 50 is for residential use, then the placement 242*a* indicates that the CGR house 30 is placed within the CGR land plot 50. More generally, in various implementations, the configurator 240 determines the placement 242*a* of the CGR object 252 based on a combination of the object characterization vector 220, the target level of detail 230 and the current state 232 of the CGR environment.

In some implementations, one or more of the values 242 indicate a size 242*b* of the CGR object 252. In some implementations, the size 242*b* indicates a number of pixels that the CGR object 252 occupies within the CGR environment 100. In various implementations, the configurator 240 determines the size 242*b* based on a combination of the object characterization vector 220, the target level of detail 230 and the current state 232 of the CGR environment 100. In some implementations, the configurator 240 determines the size 242*b* based on the type 234 of another objective-effectuator that is instantiated in the CGR environment 100. For example, the configurator 240 determines the size 242*b* of the CGR house 30 based on the plot type 51 of the CGR land plot 50. As an example, if the plot type 51 indicates that the CGR land plot 50 is in a crowded city, then the configurator 240 sets the size 242*b* of the CGR house 30 to be less than a threshold size (e.g., a size approved by the city). By contrast, if the plot type 51 indicates that the CGR land plot 50 is farmland, then the configurator 240 sets the size 242*b* of the CGR house 30 to be greater than the threshold size.

In some implementations, one or more of the values 242 indicate configurations 242*c* of nested CGR objects. For example, the values 242 indicate configurations 242*c* for the nested objective-effectuators 228. As an example, the configurator 240 generates the configurations 242*c* for the CGR kitchen 60, the CGR appliances 70, and the CGR furniture 80. In some implementations, the configurations 242*c* for the nested CGR objects are a function of the target level of detail 230. For example, if the target level of detail 230 is greater than a threshold level of detail, then the configurator 240 generates configurations 242*c* for greater than a threshold number of nested CGR objects (e.g., for a majority of the nested CGR objects, for example, for the CGR kitchen 60, the CGR appliances 70 and the CGR furniture 80). By contrast, if the target level of detail 230 is less than the threshold level of detail, then the configurator 240 generates the configurations 242*c* for less than the threshold number of nested CGR objects (e.g., for a minority of the nested CGR objects, for example, for the CGR kitchen 60 and the CGR furniture 80 but not the CGR appliances 70).

In some implementations, the values 242 increase a compatibility of the CGR object 252 with other CGR objects in the CGR environment. For example, the values 242 increase a compatibility of the CGR house 30 with the CGR land plot 50 (e.g., the values 242 make the CGR house 30 more suitable for the CGR land plot 50). As an example, in some implementations, the size 242*b* allows the CGR object 252 to fit into another CGR object in the CGR environment (e.g., the size 242*b* allows the CGR house 30 to be placed onto the CGR land plot 50).

In some implementations, the values 242 increase coordination between the CGR object 252 and other CGR objects in the CGR environment. For example, the values 242 increase coordination between the CGR house 30 and the CGR land plot 50. In some implementations, the values 242 allow the CGR object 252 to interface with the other CGR objects in the CGR environment. As an example, if the CGR land plot 50 includes access to city water, a city sewage system and an electrical grid, then the values 242 configure the CGR house 30 to have CGR pipes and CGR electrical wires that connect to the city water, the city sewage system and the electrical grid, respectively.

In some implementations, an objective-effectuator represented by another CGR object in the CGR environment generates the values 242. For example, an objective-effectuator represented by the CGR land plot 50 generates the values 242. In some implementations, the configurator 240 is a part of the objective-effectuator represented by the other CGR object. For example, the configurator 240 is implemented by the objective-effectuator represented by the CGR land plot 50.

In some implementations, the configurator 240 includes a neural network system that generates the values 242 based on a function of the data obtained by the data obtainer 210. For example, the object characterization vector 220, the target level of detail 230 and/or the current state 232 are provided to the neural network system as inputs, and the neural network system generates the values 242 based on the inputs. In some implementations, the neural network system includes a convolutional neural network (CNN).

In some implementations, the configurator 240 utilizes a set of rules to generate the values 242. In some implementations, at least some of the rules are generated without a user input. For example, in some implementations, the configurator 240 generates (e.g., automatically generates) at least some of the rules. In some implementations, at least some of the rules are provided by an operator (e.g., a human operator, for example, the user 102).

In some implementations, the CGR object manipulator 250 displays the CGR object 252 in the CGR environment in accordance with the values 242. In some implementations, the CGR object manipulator 250 manipulates (e.g., sets or modifies) one or more visual properties of the CGR object 252 based on the values 242. In some implementations, the CGR object manipulator 250 sends the CGR object 252 to a rendering and display pipeline. In some implementations, the CGR object manipulator 250 causes the CGR object 252 to be displayed in association with another CGR object (e.g., within the other CGR object). For example, the CGR object manipulator 250 causes the CGR house 30 to be displayed within the CGR land plot 50.

Figure 3A:
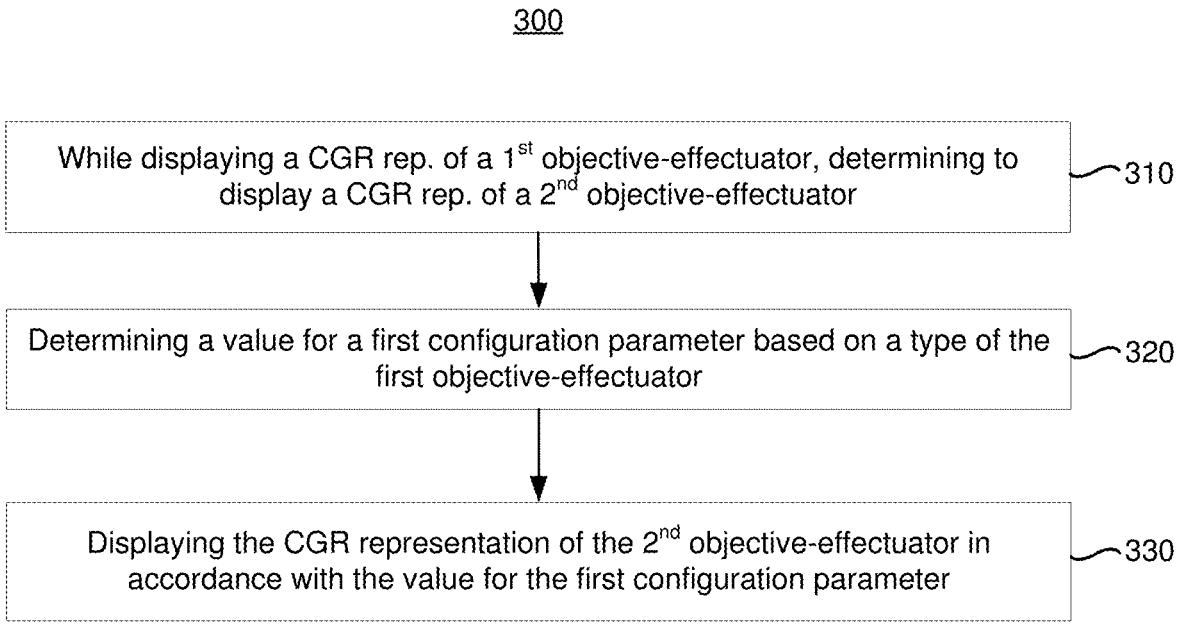
FIGS. 3A-3B are flowchart representations of a method of configuring an objective-effectuator in accordance with some implementations.

FIG. 3A is a flowchart representation of a method 300 of configuring an objective-effectuator represented by a CGR object. In various implementations, the method 300 is performed by a device with a display, a non-transitory memory and one or more processors coupled with the display and the non-transitory memory (e.g., the electronic device 103 shown in FIG. 1A). In some implementations, the method 300 is performed by processing logic, including hardware, firmware, software, or a combination thereof. In some implementations, the method 300 is performed by a processor executing code stored in a non-transitory computer-readable medium (e.g., a memory).

As represented by block 310, in various implementations, the method 300 includes while displaying a CGR representation of a first objective-effectuator in a CGR environment, determining to display a CGR representation of a second objective-effectuator in association with the CGR representation of the first objective-effectuator. For example, as shown in FIG. 1B, while displaying the CGR land plot 50, the electronic device 103 detects the user input 112 corresponding to a request to display the CGR house 30 in the CGR environment 100. In some implementations, the second objective-effectuator is associated with a set of configuration parameters. For example, as shown in FIG. 1B, the CGR house 30 is associated with the house configuration parameters 32.

As represented by block 320, in various implementations, the method 300 includes determining a value for at least a first configuration parameter of the set of configuration parameters based on a type of the first objective-effectuator. For example, as shown in FIG. 1C, the electronic device 103 determines the values 34*a*, . . . , 34*n* for the house configuration parameters 32 based on the plot type 51 of the CGR land plot 50. In some implementations, the method 300 includes determining the value without a user input that corresponds to inputting the value. In some implementations, the method 300 includes determining the value automatically.

In various implementations, determining the value for the first configuration parameter based on the type of the first objective-effectuator enhances the user experience because the user is not required to manually input the value. In some implementations, determining the value for the first configuration parameter based on the type of the first objective-effectuator improves a performance of a device (e.g., the electronic device 103) by reducing a need for a user input that corresponds to manual entry of the value, which tends to reduce wear-and-tear on the device and/or tends to extend the battery life of the device (e.g., by reducing an amount of time that the display has to be kept ON). In some implementations, determining the value for the first configuration parameter based on the type of the first objective-effectuator accelerates (e.g., speeds-up) emergent content generation, for example, because the device need not wait for user inputs that correspond to manual entry of the value.

As represented by block 330, in various implementations, the method 300 includes displaying the CGR representation of the second objective-effectuator in the CGR environment in accordance with the value for the first configuration parameter. For example, as shown in FIG. 1C, the electronic device 103 displays the CGR house 30 within the CGR land plot 50. In some implementations, the method 300 includes configuring the CGR representation of the second objective-effectuator based on the value for the first configuration parameter. For example, the electronic device 103 configures the CGR house 30 based on the values 34*a*, . . . , 34*n* for the house configuration parameters 32.

Figure 3B:
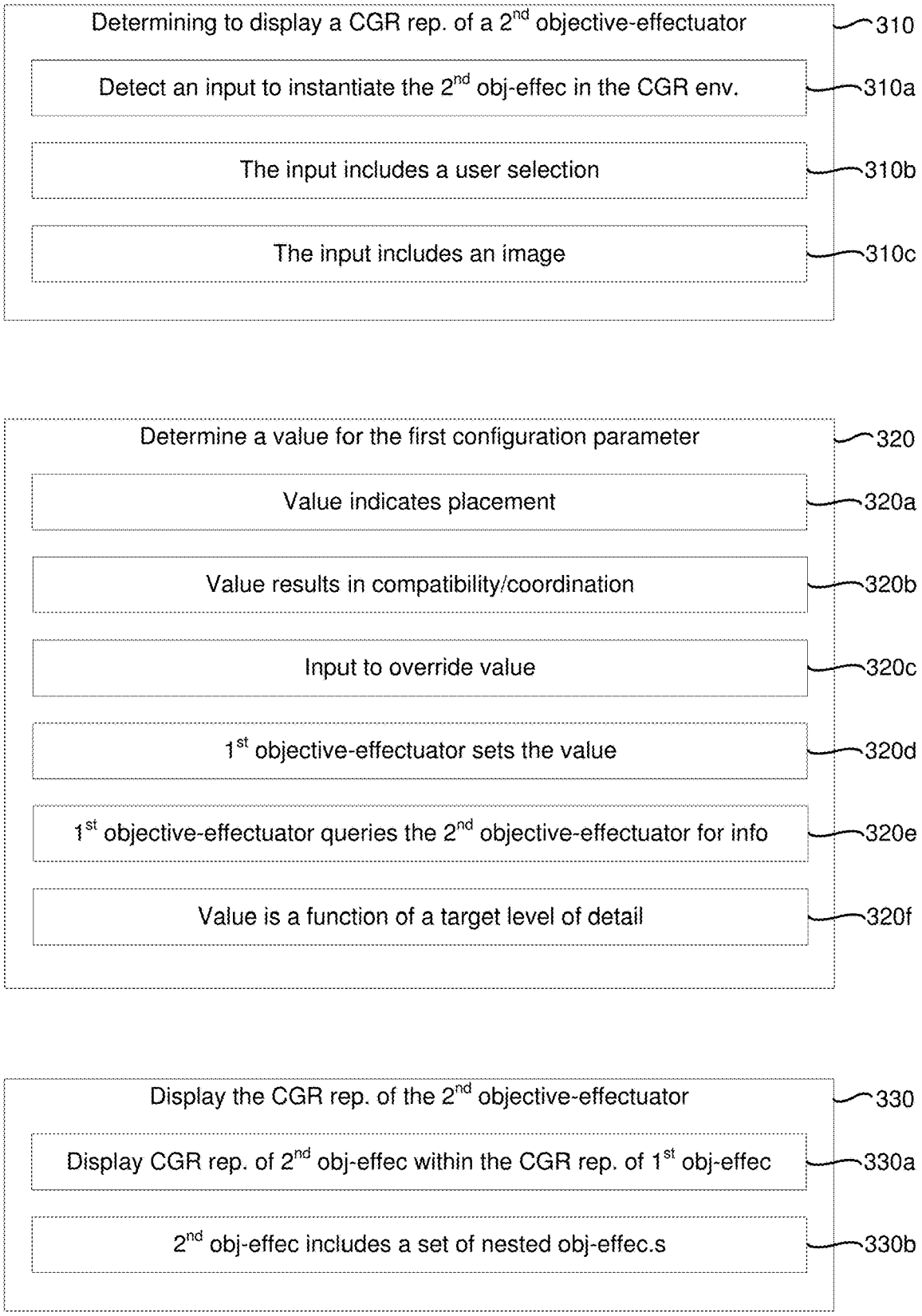

Referring to FIG. 3B, as represented by block 310*a*, in some implementations, the method 300 includes detecting an input to instantiate the CGR representation of the second objective-effectuator in the CGR environment. In some implementations, the input includes an audio input (e.g., a voice command from the user 102). As represented by block 310*b*, in some implementations, the input includes a user selection. For example, as shown in FIG. 1B, the electronic device 103 detects the user input 112 which corresponds to a request to instantiate the CGR house 30 in the CGR environment 100.

As represented by block 310*c*, in some implementations, the input includes an image that includes pixels corresponding to an object within a degree of similarity to the CGR representation of the second objective-effectuator. For example, in some implementations, the user 102 provides an image that includes a house, and the electronic device 103 determines that the CGR house 30 is within a degree of similarity to the house in the image. As such, the electronic device 103 determines to display the CGR house 30 in the CGR environment 100.

As represented by block 320*a*, in some implementations, the value indicates a placement of the CGR representation of the second objective-effectuator relative to the CGR representation of the first objective-effectuator (e.g., the placement 242*a* shown in FIG. 2). For example, one of the values 34*a*, . . . , 34*n* for the house configuration parameters 32 indicate a placement of the CGR house 30 relative to the CGR land plot 50. In some implementations, the value indicates that the CGR representation of the second objective-effectuator is to be placed at a particular distance from the CGR representation of the first objective-effectuator. In some implementations, the value indicates that the CGR representation of the second objective-effectuator is to be placed adjacent to, proximate to, or abutting from the CGR representation of the first objective-effectuator.

In some implementations, the value allows the CGR representation of the second objective-effectuator to be placed within the CGR representation of the first objective-effectuator. For example, in some implementations, the value sets a size (e.g., the size 242*b* shown in FIG. 2) of the CGR representation of the second objective-effectuator such that the CGR representation of the second objective-effectuator fits into the CGR representation of the first objective-effectuator. For example, one of the values 34*a*, . . . , 34*n* for the house configuration parameters 32 set a size of the CGR house 30 such that the CGR house 30 fits onto the CGR land plot 50.

As represented by block 320*b*, in some implementations, the value increases a compatibility between the first objective-effectuator and the second objective-effectuator. In some implementations, the value increases a compatibility between the CGR representation of the first objective-effectuator and the CGR representation of the second objective-effectuator. For example, the values 34*a*, . . . , 34*n* increase the compatibility between the CGR house 30 and the CGR land plot 50. In various implementations, increasing the compatibility between the first and second objective-effectuators reduces the need for user inputs that correspond to the user manually configuring the second objective-effectuator in order to make the second objective-effectuator more suitable for the first objective-effectuator.

In some implementations, the value allows the second objective-effectuator to function in coordination with the first objective-effectuator. For example, one or more of the values 34*a*, . . . , 34*n* allow the CGR house 30 to function in coordination with the CGR land plot 50. In some implementations, the value allows the CGR representations of the first and second objective-effectuators to interface (e.g., interact) with each other. For example, one of the values 34*a*, . . . , 34*n* provision the CGR house 30 with CGR pipes that connect to utility connections available on the CGR land plot 50.

As represented by block 320*c*, in some implementations, the method 300 includes obtaining an input to change the value. For example, as shown in FIG. 1D, the electronic device 103 detects the user input 114 corresponding to a request to change the value 34*n* for the nth house configuration parameter 32*n*. In some implementations, the input includes an audio input (e.g., a voice command) In some implementations, the input includes an image. For example, the user 102 can provide an image of a house and the electronic device 103 can generate an input to modify one of the values 34*a*, . . . , 34*n* so that the CGR house 30 appears within a degree of similarity to the house in the image.

As represented by block 320*d*, in some implementations, the first objective-effectuator sets the value for the first configuration parameter. For example, in some implementations, an objective-effectuator represented by the CGR land plot 50 sets the values 34*a*, . . . , 34*n* for the house configuration parameters 32. In some implementations, the first objective-effectuator is implemented by the device 200 shown in FIG. 2 (e.g., the first objective-effectuator is implemented by the configurator 240).

As represented by block 320*e*, in some implementations, the first objective-effectuator queries the second objective-effectuator for information regarding the second objective-effectuator. For example, a first objective-effectuator represented by the CGR land plot 50 queries a second objective-effectuator represented by the CGR house 30 for information regarding the second objective-effectuator. In some implementations, the first objective-effectuator obtains an object characterization vector (e.g., the object characterization vector 220 shown in FIG. 2) that characterizes the second objective-effectuator. In such implementations, the first objective-effectuator generates the values (e.g., the values 34*a*, . . . , 34*n*) based on the information provided by the second objective-effectuator (e.g., based on the object characterization vector, for example, based on the object characterization vector 220).

In some implementations, the information provided by the second objective-effectuator indicates a placement preference (e.g., the placement affinity 224 shown in FIG. 2) for the CGR representation of the second objective-effectuator. For example, in some implementations, the placement preference indicates whether the CGR representation has an affinity for (e.g., is more suited for) flat surfaces, walls, etc. In some implementations, the placement preference indicates a type of surface (e.g., kitchen countertop, coffee table, etc.).

In some implementations, the information provided by the second objective-effectuator includes characteristic values that characterize the CGR representation of the second objective-effectuator (e.g., the characteristic values 222). In some implementations, the information provided by the second objective-effectuator includes configuration parameters associated with the second objective-effectuator (e.g., the configuration parameters 226). In some implementations, the information provided by the second objective-effectuator indicates nested objective-effectuators (e.g., other objective-effectuators that are nested within the second objective-effectuator, for example, the nested objective-effectuators 228).

As represented by block 320*f*, in some implementations, the value is a function of a target level of detail (e.g., the target level of detail 230 shown in FIG. 2). For example, in some implementations, the method 300 includes setting values that correspond to nested objective-effectuators when the target level of detail is greater than a threshold level of detail. In some implementations, the method 300 includes forgoing setting the values that correspond to the nested objective-effectuators when the target level of detail is less than the threshold level of detail. For example, if the user 102 is looking at the CGR house 30 from a CGR airplane, then a value corresponding to the roof of the CGR house 30 is set to null. However, if the user 102 is looking at the CGR house 30 from a front yard of the CGR house 30, then the value corresponding to the roof of the CGR house 30 is set such that the roof has a particular color and texture. In some implementations, the method 300 includes changing the value in response to a change in the target level of detail. For example, as the user 102 comes closer to the CGR house 30, the value corresponding to the roof changes from null to a particular color and subsequently to indicate a texture of the roof.

As represented by block 330*a*, in some implementations, the CGR representation of the second objective-effectuator is displayed within the CGR representation of the first objective-effectuator. For example, as shown in FIG. 1C, the CGR house 30 is displayed within the CGR land plot 50. As represented by block 330*b*, in some implementations, the second objective-effectuator includes a set of nested objective-effectuators. For example, as shown in FIG. 1F, the CGR house 30 includes the CGR kitchen 60, the CGR appliances 70, and the CGR furniture 80.

Figure 4:
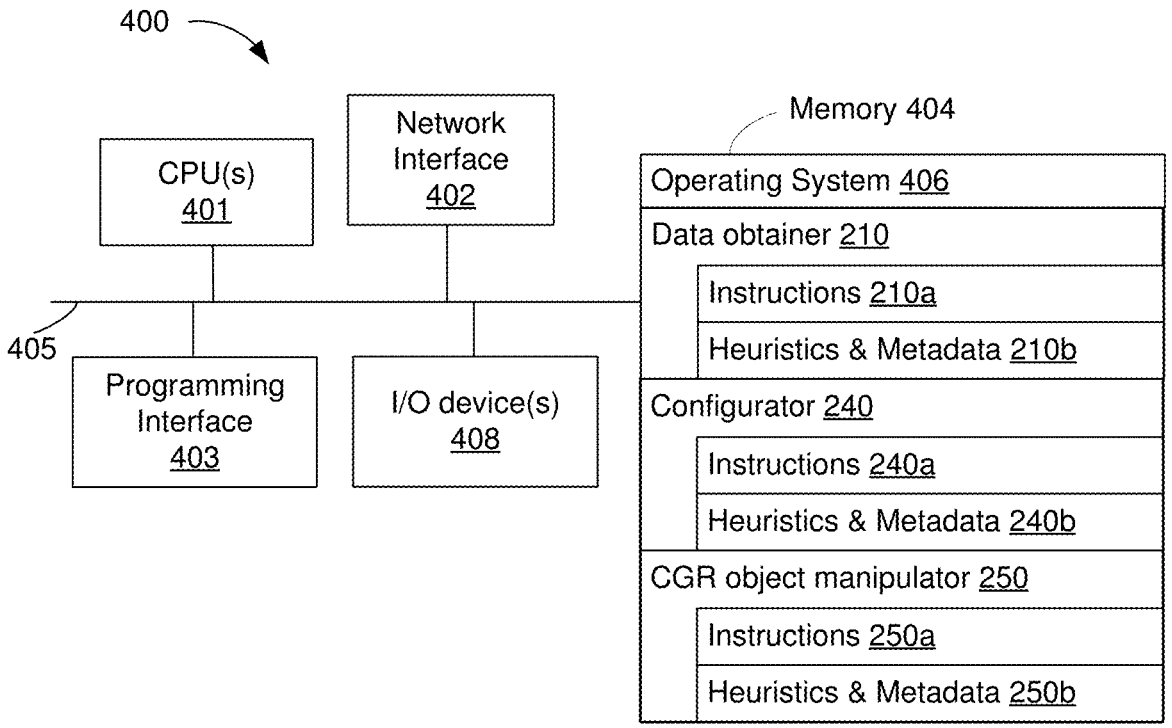
FIG. 4 is a block diagram of a device that configures an objective-effectuator in accordance with some implementations.

FIG. 4 is a block diagram of a device 400 that configures objective-effectuators in accordance with some implementations. While certain specific features are illustrated, those of ordinary skill in the art will appreciate from the present disclosure that various other features have not been illustrated for the sake of brevity, and so as not to obscure more pertinent aspects of the implementations disclosed herein. To that end, as a non-limiting example, in some implementations the device 400 includes one or more processing units (CPUs) 401, a network interface 402, a programming interface 403, a memory 404, one or more input/output (I/O) devices 408, and one or more communication buses 405 for interconnecting these and various other components.

In some implementations, the network interface 402 is provided to, among other uses, establish and maintain a metadata tunnel between a cloud hosted network management system and at least one private network including one or more compliant devices. In some implementations, the one or more communication buses 405 include circuitry that interconnects and controls communications between system components. The memory 404 includes high-speed random access memory, such as DRAM, SRAM, DDR RAM or other random access solid state memory devices, and may include non-volatile memory, such as one or more magnetic disk storage devices, optical disk storage devices, flash memory devices, or other non-volatile solid state storage devices. The memory 404 optionally includes one or more storage devices remotely located from the one or more CPUs 401. The memory 404 comprises a non-transitory computer readable storage medium.

In some implementations, the one or more I/O devices 408 include a display for displaying a CGR environment (e.g., the CGR environment 100 shown in FIGS. 1A-1F). In some implementations, the display includes a video pass-through display which displays at least a portion of a physical environment surrounding the device 400 as an image captured by a scene camera. In various implementations, the display includes an optical see-through display which is at least partially transparent and passes light emitted by or reflected off the physical environment.

In some implementations, the memory 404 or the non-transitory computer readable storage medium of the memory 404 stores the following programs, modules and data structures, or a subset thereof including an optional operating system 406, the data obtainer 210, the configurator 240, and the CGR object manipulator 250. In various implementations, the device 400 performs the method 300 shown in FIGS. 3A-3B. In various implementations, the device 400 implements the electronic device 103 and/or the device 200.

In some implementations, the data obtainer 210 obtains data that is utilized to configure an objective-effectuator or a CGR representation of the objective-effectuator. In some implementations, the data obtainer 210 obtains inputs (e.g., user inputs). To that end, the data obtainer 210 includes instructions 210*a*, and heuristics and metadata 210*b*.

As described herein, in some implementations, the configurator 240 determines values for configuration parameters of an objective-effectuator based on a type of another objective-effectuator. In some implementations, the configurator 240 performs the operations(s) represented by block 320 in FIGS. 3A and 3B. To that end, the configurator 240 includes instructions 240*a*, and heuristics and metadata 240*b*.

In some implementations, the CGR object manipulator 250 displays the CGR representation of the objective-effectuator in accordance with the values for the configuration parameters that the configurator 240 determined. In some implementations, the CGR object manipulator 250 performs the operations represented by block 330 in FIGS. 3A and 3B. To that end, the CGR object manipulator 250 instructions 250*a*, and heuristics and metadata 250*b*.

While various aspects of implementations within the scope of the appended claims are described above, it should be apparent that the various features of implementations described above may be embodied in a wide variety of forms and that any specific structure and/or function described above is merely illustrative. Based on the present disclosure one skilled in the art should appreciate that an aspect described herein may be implemented independently of any other aspects and that two or more of these aspects may be combined in various ways. For example, an apparatus may be implemented and/or a method may be practiced using any number of the aspects set forth herein. In addition, such an apparatus may be implemented and/or such a method may be practiced using other structure and/or functionality in addition to or other than one or more of the aspects set forth herein.

It will also be understood that, although the terms "first", "second", etc. may be used herein to describe various elements, these elements should not be limited by these terms. These terms are only used to distinguish one element from another. For example, a first node could be termed a second node, and, similarly, a second node could be termed a first node, which changing the meaning of the description, so long as all occurrences of the "first node" are renamed consistently and all occurrences of the "second node" are renamed consistently. The first node and the second node are both nodes, but they are not the same node.

The terminology used herein is for the purpose of describing particular implementations only and is not intended to be limiting of the claims. As used in the description of the implementations and the appended claims, the singular forms "a", "an", and "the" are intended to include the plural forms as well, unless the context clearly indicates otherwise. It will also be understood that the term "and/or" as used herein refers to and encompasses any and all possible combinations of one or more of the associated listed items. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in accordance with a determination" or "in response to detecting", that a stated condition precedent is true, depending on the context. Similarly, the phrase "if it is determined [that a stated condition precedent is true]" or "if [a stated condition precedent is true]" or "when [a stated condition precedent is true]" may be construed to mean "upon determining" or "in response to determining" or "in accordance with a determination" or "upon detecting" or "in response to detecting" that the stated condition precedent is true, depending on the context.

What is claimed is:

1. A method comprising:

at a device including a display, a non-transitory memory and one or more processors coupled with the display and the non-transitory memory:

after displaying a computer-generated reality (CGR) representation of a first objective-effectuator in a CGR environment:

determining to display a CGR representation of a second objective-effectuator within the CGR representation of the first objective-effectuator, wherein the second objective-effectuator is associated with a set of configuration parameters;

determining a value for at least a first configuration parameter of the set of configuration parameters based on a type of the first objective-effectuator; and displaying the CGR representation of the second objective-effectuator within the CGR representation of the first objective-effectuator in the CGR environment in accordance with the value for the first configuration parameter.

2. The method of claim 1, wherein the value indicates a placement of the CGR representation of the second objective-effectuator relative to the CGR representation of the first objective-effectuator.

3. The method of claim 1, wherein the value allows the CGR representation of the second objective-effectuator to be placed within the CGR representation of the first objective-effectuator.

4. The method of claim 1, wherein the value increases a compatibility between the first objective-effectuator and the second objective-effectuator.

5. The method of claim 1, wherein the value allows the second objective-effectuator to function in coordination with the first objective-effectuator.

6. The method of claim 1, further comprising:

obtaining an input to change the value.

7. The method of claim 1, wherein the first objective-effectuator sets the value.

8. The method of claim 1, wherein the first objective-effectuator queries the second objective-effectuator for information regarding the second objective-effectuator, and the first objective-effectuator determines the value based on the information provided by the second objective-effectuator.

9. The method of claim 8, wherein the information indicates a placement preference for the CGR representation of the second objective-effectuator.

10. The method of claim 1, wherein the value is a function of a target level of detail.

11. The method of claim 10, further comprising:

changing the value in response to a change in the target level of detail.

12. The method of claim 1, wherein determining to display the CGR representation of the second objective-effectuator comprises:

detecting an input to instantiate the CGR representation of the second objective-effectuator in the CGR environment.

13. The method of claim 12, wherein the input includes a user selection.

14. The method of claim 12, wherein the input includes an image that includes pixels corresponding to an object within a degree of similarity to the CGR representation of the second objective-effectuator.

15. The method of claim 1, wherein the second objective-effectuator includes a set of nested objective-effectuators, and the value for the first configuration parameter defines a configuration of the set of nested objective-effectuators.

16. A device comprising:

one or more processors;

a display;

a non-transitory memory; and one or more programs stored in the non-transitory memory, which, when executed by the one or more processors, cause the device to:

after displaying a computer-generated reality (CGR) representation of a first objective-effectuator in a CGR environment:

determine to display a CGR representation of a second objective-effectuator within the CGR representation of the first objective-effectuator, wherein the second objective-effectuator is associated with a set of configuration parameters;

determine a value for at least a first configuration parameter of the set of configuration parameters based on a type of the first objective-effectuator; and display the CGR representation of the second objective-effectuator within the CGR representation of the first objective-effectuator in the CGR environment in accordance with the value for the first configuration parameter.

17. The device of claim 16, wherein the value indicates a placement of the CGR representation of the second objective-effectuator relative to the CGR representation of the first objective-effectuator.

18. A non-transitory memory storing one or more programs, which, when executed by one or more processors of a device with a display, cause the device to:

after displaying a computer-generated reality (CGR) representation of a first objective-effectuator in a CGR environment:

determine to display a CGR representation of a second objective-effectuator within the CGR representation of the first objective-effectuator, wherein the second objective-effectuator is associated with a set of configuration parameters;

determine a value for at least a first configuration parameter of the set of configuration parameters based on a type of the first objective-effectuator; and display the CGR representation of the second objective-effectuator within the CGR representation of the first objective-effectuator in the CGR environment in accordance with the value for the first configuration parameter.

19. The non-transitory memory of claim 18, wherein the value indicates a placement of the CGR representation of the second objective-effectuator relative to the CGR representation of the first objective-effectuator.

* * * * *